US007056200B2

(12) United States Patent
Nelson

(10) Patent No.: US 7,056,200 B2
(45) Date of Patent: Jun. 6, 2006

(54) QUICK CHANGE CONNECTOR FOR GRINDING WHEEL

(75) Inventor: Eric W. Nelson, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 107 days.

(21) Appl. No.: 09/945,923

(22) Filed: Sep. 4, 2001

(65) Prior Publication Data

US 2003/0166385 A1 Sep. 4, 2003

(51) Int. Cl.
*B24B 23/00* (2006.01)

(52) U.S. Cl. ..... 451/359; 451/510

(58) Field of Classification Search ..... 451/458, 451/548, 508–510, 363, 359
See application file for complete search history.

(56) References Cited

U.S. PATENT DOCUMENTS

| | | | | |
|---|---|---|---|---|
| 2,118,409 | A * | 5/1938 | Loewy | 451/548 |
| 2,156,002 | A | 4/1939 | Tinnerman | |
| 2,278,301 | A * | 3/1942 | Bauer | 451/548 |
| 2,806,331 | A * | 9/1957 | Hoye | 451/342 |
| 3,136,100 | A | 6/1964 | Wheel | |
| 3,204,371 | A * | 9/1965 | Booth | 451/342 |
| 3,250,045 | A * | 5/1966 | Caserta | 451/548 |
| 3,250,047 | A * | 5/1966 | Block | 451/491 |
| 3,256,646 | A * | 6/1966 | Mockli | 451/544 |
| 3,333,371 | A | 8/1967 | Pratt et al. | |
| 3,561,938 | A | 2/1971 | Block et al. | |
| 3,896,593 | A * | 7/1975 | Rine | 451/548 |
| 4,015,371 | A | 4/1977 | Grayston | |
| 4,088,729 | A | 5/1978 | Sherman | |
| 4,237,659 | A | 12/1980 | Welsch et al. | |
| 4,251,955 | A | 2/1981 | Shawke | |
| 4,314,827 | A | 2/1982 | Leitheiser et al. | |
| 4,439,907 | A | 4/1984 | Block et al. | |
| 4,518,397 | A | 5/1985 | Leitheiser et al. | |
| 4,541,205 | A | 9/1985 | Patrello | |
| 4,588,419 | A | 5/1986 | Caul et al. | |
| 4,623,364 | A | 11/1986 | Cottringer et al. | |
| 4,694,615 | A | 9/1987 | MacKay, Jr. | |
| 4,744,802 | A | 5/1988 | Schwabel | |
| 4,751,137 | A | 6/1988 | Halg et al. | |
| 4,754,577 | A | 7/1988 | MacKay, Jr. | |
| 4,754,578 | A | 7/1988 | MacKay, Jr. | |
| 4,760,670 | A | 8/1988 | MacKay, Jr. | |
| 4,770,671 | A | 9/1988 | Monroe et al. | |
| 4,878,316 | A | 11/1989 | MacKay, Jr. | |
| 4,881,951 | A | 11/1989 | Monroe et al. | |

(Continued)

FOREIGN PATENT DOCUMENTS

| | | |
|---|---|---|
| FR | 2 139 264 | 1/1973 |

(Continued)

*Primary Examiner*—M. Rachuba
(74) *Attorney, Agent, or Firm*—Trisha D. Adamson; David B. Patchett

(57) ABSTRACT

An abrasive article for a grinder having a motor-driven, externally-threaded spindle. The abrasive article includes a molded abrasive disk with an integrally molded fastener. The molded abrasive disk includes abrasive particles disbursed in a binder. The molded abrasive disk has a first major surface, a second major surface and an integrally molded fastener. The fastener has a body portion with an aperture and first and second ends, an outwardly extending flange with a front surface at the first end, and an inwardly extending flange including a single internal thread at the second end. The fastener is molded into the molded abrasive disk so that the front surface does not extend above the first major surface.

8 Claims, 3 Drawing Sheets

U.S. PATENT DOCUMENTS

| | | | | |
|---|---|---|---|---|
| 4,896,463 | A | | 1/1990 | MacKay, Jr. |
| 4,899,494 | A | | 2/1990 | MacKay, Jr. |
| 4,924,634 | A | | 5/1990 | MacKay, Jr. |
| 4,933,373 | A | | 6/1990 | Moren |
| 4,934,107 | A | | 6/1990 | MacKay, Jr. |
| 4,979,336 | A | | 12/1990 | MacKay, Jr. |
| 5,011,508 | A | | 4/1991 | Wald et al. |
| 5,031,361 | A | | 7/1991 | MacKay, Jr. |
| 5,090,968 | A | | 2/1992 | Pellow |
| 5,139,978 | A | | 8/1992 | Wood |
| 5,152,106 | A | | 10/1992 | MacKay, Jr. |
| 5,201,916 | A | | 4/1993 | Berg et al. |
| 5,227,104 | A | | 7/1993 | Bauer |
| 5,287,659 | A | | 2/1994 | Timmons et al. |
| 5,316,812 | A | | 5/1994 | Stout et al. |
| 5,339,571 | A | | 8/1994 | Timmons et al. |
| 5,366,523 | A | | 11/1994 | Rowenhorst et al. |
| 5,429,647 | A | | 7/1995 | Larmie |
| 5,436,063 | A | | 7/1995 | Follett et al. |
| 5,468,176 | A | * | 11/1995 | Udert et al. ..... 451/359 |
| 5,498,269 | A | | 3/1996 | Larmie |
| 5,516,326 | A | * | 5/1996 | Virnich ..... 451/340 |
| 5,538,464 | A | | 7/1996 | MacKay, Jr. |
| 5,551,963 | A | | 9/1996 | Larmie |
| 5,951,389 | A | | 9/1999 | Hettes et al. |
| 6,095,910 | A | | 8/2000 | Luedeke |
| 6,332,836 | B1 | * | 12/2001 | Tseng ..... 451/359 |

FOREIGN PATENT DOCUMENTS

| | | |
|---|---|---|
| JP | 60-94271 | 5/1985 |

* cited by examiner

QUICK CHANGE CONNECTOR FOR GRINDING WHEEL

FIELD OF THE INVENTION

The present invention relates to an abrasive article comprising a molded abrasive disk with an integrally molded fastener, and in particular, to an integrally molded fastener with a single internal thread and a front surface that does not extend above a major surface of the abrasive disk.

BACKGROUND OF THE INVENTION

The grinding wheel used on portable grinders generally consists of an abrasive disk having a centrally located bore for receiving an internally threaded collar nut. The collar nut is adapted to be mounted to the externally threaded spindle of the grinder. Typically, a support flange is positioned on the spindle between the grinding wheel and an annular shoulder formed on the spindle to provide backing support for the grinding wheel. The support flange is typically configured to engage the backside of the abrasive disk around its outer radial edge. The direction of rotation of the spindle when the grinder is energized is such that the collar nut will self-thread onto the spindle until a tight frictional engagement is provided between the support flange and the grinding wheel. The grinding wheel can then be further tightened onto, or subsequently removed from, the spindle by applying a wrench to the collar nut.

The collar nut in such conventional assemblies is typically not permanently affixed to the abrasive disk, but rather is intended to be reused when a worn disk is replaced. In addition to the possibility of losing or misplacing the collar nut, this type of assembly is further disadvantageous from the standpoint that replacement abrasive disks must have properly sized bores, which are not uniform for all brands and models. Moreover, the application of driving torque from the spindle to the abrasive disk is solely through the frictional interfaces between the abrasive disk and the spindle directly or between the abrasive disk and the supporting flange and the supporting flange and the spindle. Consequently, under load the abrasive disk subassembly may slip at either of these frictional interfaces. To combat slippage, abrasive disk subassemblies are frequently tightened onto the spindle to such a degree that subsequent removal becomes difficult.

To alleviate some of these problems, various "hubbed"-type abrasive disk subassemblies have been proposed, such as that shown in U.S. Pat. No. 4,694,615 (MacKay, Jr.). Hubbed-type abrasive disk subassemblies include a backing flange that is permanently affixed to the backside of the abrasive disk by attachment to the hub portion of the collar nut using a fastener. The collar nut, backing flange, and fastener become an integral part of the subassembly. The entire subassembly is thus intended to be discarded when the abrasive disk is worn. Hubbed-type grinding wheels are generally intended to be used in combination with specially designed support flanges adapted for engaging driving surfaces on the backing flange affixed to the disk. While the hubbed-type grinding wheels are much less susceptible to slippage problems, they are substantially more expensive than conventional non-hubbed grinding wheels and consequently are not as widely used.

U.S. Pat. No. 5,339,571 (Timmons et al.) discloses an internally threaded collar nut with a shape that is substantially noncircular so as to preclude relative rotation between the abrasive disk and the collar nut. The collar nut is a relatively expensive machined component that in some embodiments is discarded with the worn abrasive disk. The collar nut also includes a head portion that extends above one of the major surfaces of the abrasive disk, potentially interfering with the use of that major surface on a work piece. Due to the mass of abrasive disks, it is believed in the art that a machined collar nut, such as disclosed in the '571 patent, is required.

Accordingly, there is a need for an improved grinding wheel subassembly that provides a positive means of coupling the grinding wheel to the spindle of the grinder without the expense of the hubbed-type wheel subassemblies.

BRIEF SUMMARY OF THE INVENTION

The present invention is directed to an abrasive article for a grinder having a motor-driven, externally threaded spindle. The abrasive article includes a molded abrasive disk with an integrally molded fastener. The molded abrasive disk comprises abrasive particles distributed in a binder. The abrasive disk has a first major surface, a second major surface and an integrally molded fastener. The fastener has a body portion with an aperture and first and second ends, an outwardly extending flange with a front surface at the first end, and an inwardly extending flange comprising a single internal thread at the second end. The fastener is molded into the abrasive disk so that the front surface does not extend above the first major surface.

In one embodiment, the first major surface comprises a planar working surface. In another embodiment, the first major surface comprises a depressed center section and an annular working section such that the front surface of the fastener does not extend above the depressed center section. The front surface of the fastener is generally co-planar with the first major surface of the abrasive disk.

The fastener preferably includes mounting apertures at least partially filled with abrasive particles and binder. In one embodiment, the outwardly extending flange comprises a planar portion generally perpendicular to an axis of the thread. The fastener typically comprises a stamped member.

The fastener also preferably includes tines embedded in the molded abrasive disk. The tines can be generally perpendicular to the front surface and embedded in the molded abrasive disk. The tines embedded in the molded abrasive disk can optionally include a first portion generally perpendicular to the front surface and a second distal portion at an angle less then ninety degrees with respect to the front surface.

The body portion of the fastener typically includes a generally cylindrical shape. In one embodiment, the body portion comprises a height greater than a thickness of the molded abrasive disk. In another embodiment, the inwardly extending flange on the fastener is located between the first and second major surfaces of the molded abrasive disk.

A backing plate is typically used that engages with the spindle and the second major surface of the abrasive disk. The molded abrasive disk is compressed between the backing plate and the outwardly extending flange when the abrasive article is engaged with the treaded spindle. The molded abrasive disk can optionally include an integrally molded reinforcing member, such as a scrim.

The present invention is also directed to a method of forming an abrasive article for a grinder having a motor-driven, externally threaded spindle. The method includes the steps of preparing a mixture of abrasive particles dispersed in a polymeric binder. The mixture is poured into a form. A fastener with a single internal thread is positioned in the mixture so that a front surface of the fastener does not extend above a first major surface of the mixture. The polymeric binder is cured. The abrasive article is removed from the form. The fastener molded into the abrasive article can be threaded onto a spindle of a tool. In an alternate embodiment, the fastener is located with its front surface resting on a bottom surface of the form. The mixture is poured into the form around the fastener and cured. In some embodiment, the second end of the fastener extends above the mixture in the form. The mixture preferably does not migrate or flow into the center aperture of the fastener.

BRIEF DESCRIPTION OF THE SEVERAL VIEWS OF THE DRAWING

Further features of the invention will become more apparent from the following detailed description of specific embodiments thereof when read in conjunction with the accompany drawings.

DETAILED DESCRIPTION OF THE INVENTION

Figure 1:
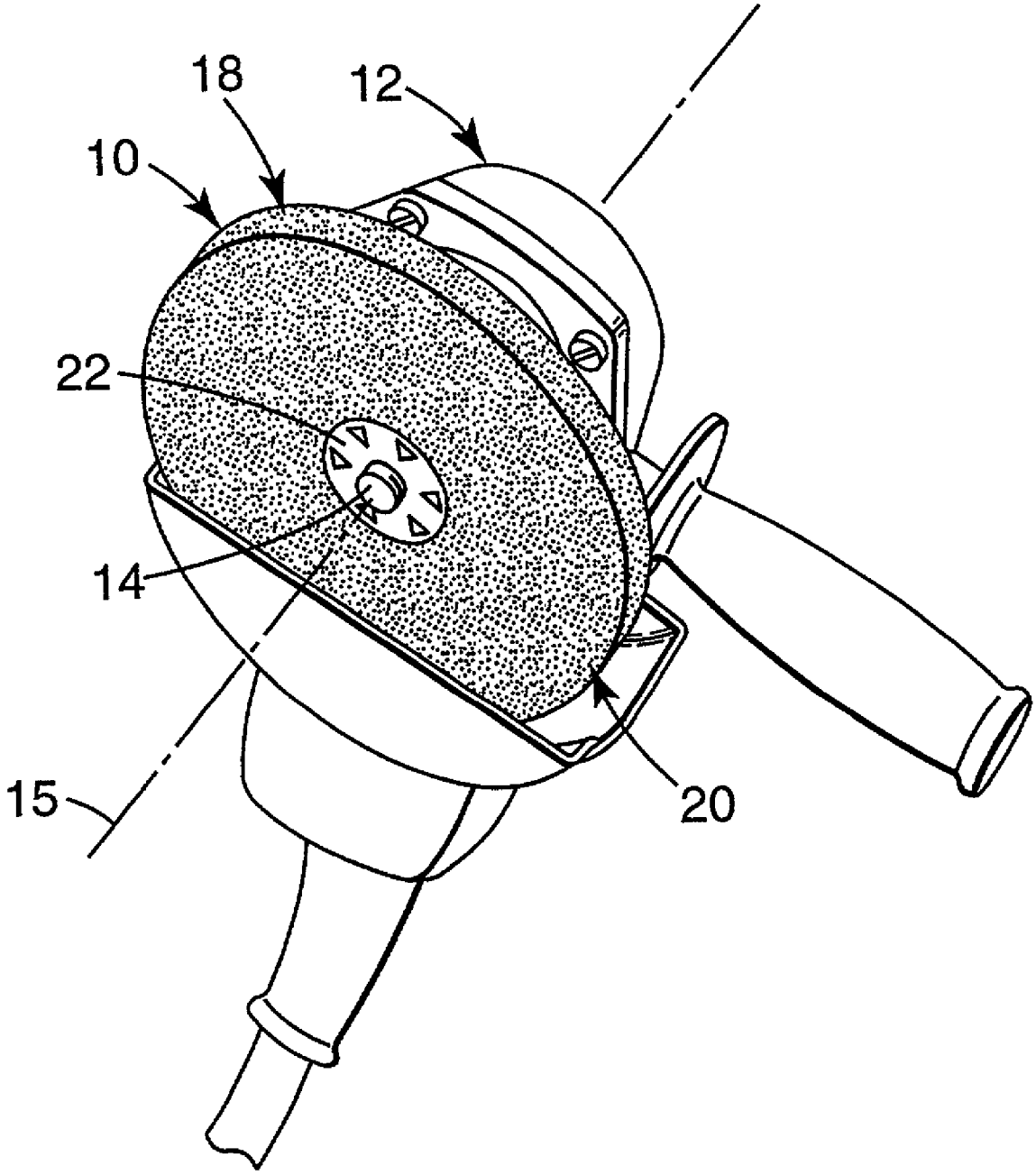
FIG. 1 is a perspective view of an abrasive article in accordance with the present invention mounted on a tool.

FIG. 1 is a perspective view of an exemplary abrasive article 10 in accordance with the present invention. Abrasive article 10 is shown mounted to tool (as shown, an angle grinder) 12. The abrasive article 10 is threaded onto externally threaded spindle 14 on the tool 12. The spindle 14 defines a longitudinal axis 15 extending through the center of abrasive article 10. Although abrasive article 10 is shown mounted to angle grinder 12, it would be understood that any tool having a rotational shaft could be used in conjunction with abrasive article 10 (e.g., a drill).

Figure 2:
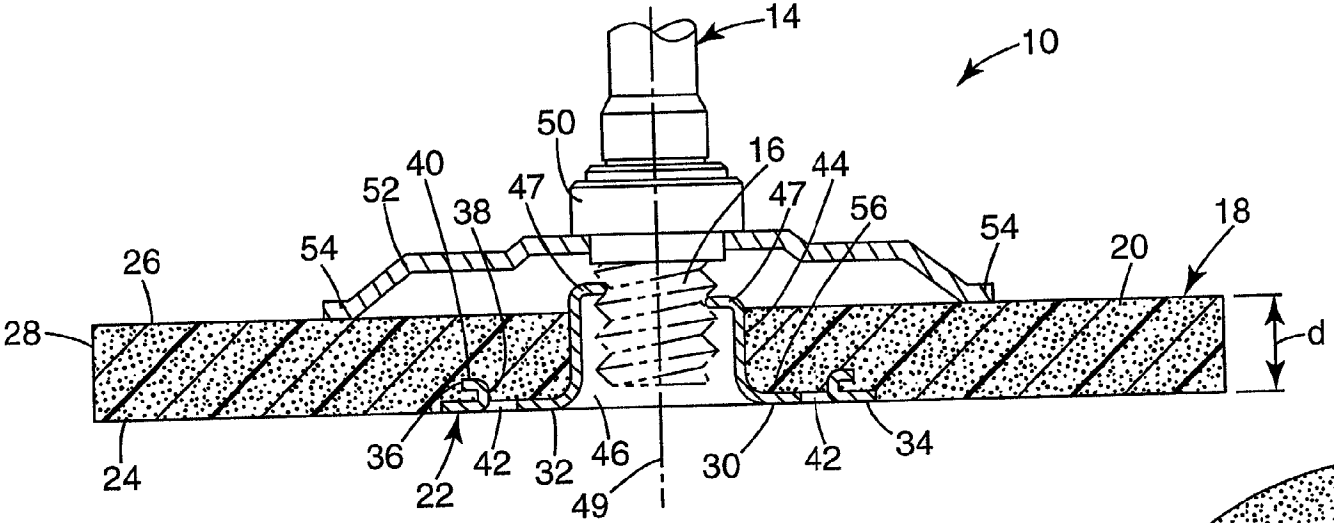
FIG. 2 is a cross-sectional view of an abrasive article in accordance with the present invention.

FIG. 2 is a sectional view of the abrasive article 10 shown mounted to externally threaded portion 16 of the spindle 14. The abrasive article 10 comprises a molded abrasive disk 18 of abrasive material 20 molded around fastener 22. The abrasive material 20 is typically abrasive particles distributed in a binder molded to form the desired shape. Prior to curing, the mixture of abrasive particles and binder is sufficiently plastic to assume the shape of the form into which it is placed. In the illustrated embodiment, the abrasive material 20 is formed to be a disk shape or annulus with a first major surface 24, a second major surface 26 and an edge surface 28. The size of the edge surface 28 is determined by the thickness "d" of the molded abrasive disk 18. Although the edge surface 28 is illustrated as generally flat, the abrasive material 20 can easily be molded to have a variety of shapes. As used herein, "molded abrasive disk" refers to abrasive particles dispersed throughout and adhered within a polymeric binder formed into a self-supporting abrasive structure.

In the illustrated embodiment, the abrasive article 10 has a circular cross-section. By "generally circular" it is meant that the abrasive article 10 is round in shape, and is typically circular, however other shaped (e.g., hexagonal) can be used without departing from the spirit and scope of the invention.

The fastener 22 includes an outwardly extending flange 30 with a front surface 32. The fastener 22 is integrally molded in the molded abrasive disk 18 before the abrasive material 20 is fully cured. Aperture 46 is formed by the fastener 22 displacing abrasive material 20 during the molding process. The fastener 22 is preferably located in the molded abrasive disk 18 so that the outwardly extending flange 30 is generally co-planar with, or slightly recessed below, the first major surface 24. The fastener is also preferably located in the physical and gravitational center of the molded abrasive disk 18.

In the embodiment of FIG. 2, the fastener 22 is concentric with the edge surface 28. The front surface 32 preferably does not extend above the first major surface 24. In some embodiments, the front surface 32 includes a generally planar portion 34 that is co-planar with the first major surface 24. For embodiments where the abrasive material 20 has sufficient thickness "d" the front surface 32 may be recessed below the first major surface 24.

Molding the fastener 22 into the abrasive material 20 allows a quick-change fastener to be economically inserted into the abrasive article 10. The fastener 22 is lightweight, concentric and rotationally fixed with respect to the molded abrasive disk 18 so that the entire abrasive article 10 can be rotated to thread and unthread the fastener 22 from the threaded shaft 16, rather than by using wrenches, as was previously required. The result is a significant improvement in user convenience, allowing quick change of abrasive disks, which is desirable when each disk becomes worn or when a disk having different abrasive media is needed.

The outwardly extending flange 30 preferably includes one or more tines 36 that extend into the molded abrasive disk 18. The tines 36 can be perpendicular to the outwardly extending flange 30 or bent in various ways. For example, the tines 36 in FIG. 2 include a first portion 38 that is perpendicular to the outwardly extending flange 30 and a second portion 40 that is parallel to the outwardly extending flange 30. This configuration enhances the structural integrity of the bond between the fastener 22 and the molded abrasive disk 18. In particular, the tines 36 permit a substantial level of torque to be applied to the fastener 22 by the spindle 14 without slippage between the fastener 22 and the molded abrasive disk 18.

Figure 3:
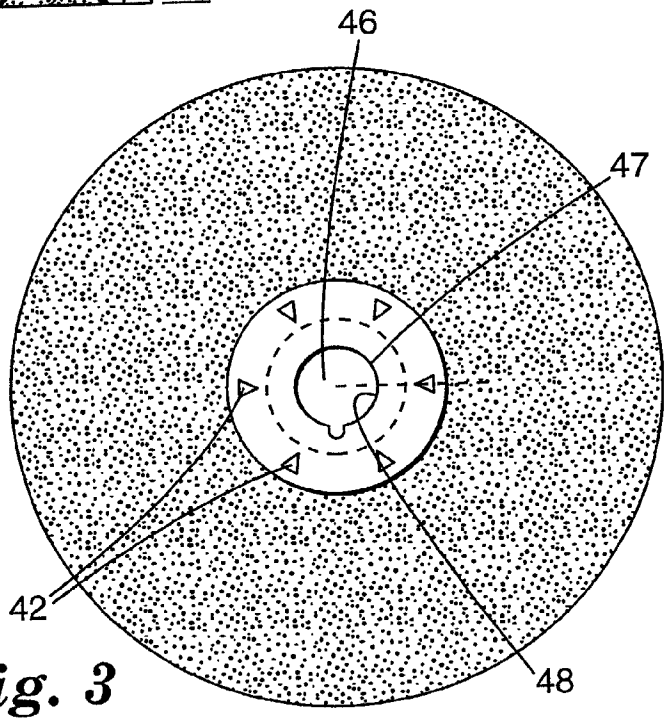
FIG. 3 is a top view of the abrasive article of FIG. 2.

As illustrated in FIGS. 2 and 3, the tines 36 are formed from a portion of the material comprising the outwardly extending flange 30. Consequently, adjacent to the tines 36 are mounting apertures 42 into which a portion of the abrasive material 20 flows during molding of the abrasive article 10. The cured or hardened abrasive material 20 in the molding apertures 36 also prevent slippage between the fastener 22 and the molded abrasive disk 18.

The fastener 22 includes a body portion 44 that extends rearward from the outwardly extending flange 30. The body portion 44 forms aperture 46 in the abrasive material 20. The cross-section of the body portion 44 can be a circle, oval, polygon or any curvilinear shape. Non-circular cross sections for the body portion 44 are desirable to maintain a positive lock between the fastener 22 and the molded abrasive disk 18.

In the embodiment of FIG. 2, the body portion 44 extends above second major surface 26 of the molded abrasive disk 18. The distal most end of the body portion 44 includes an inwardly extending flange 47 that forms a single internal thread 48 adapted to engage with the treaded portion 16 of spindle 14 (see also, FIG. 3). The internal thread 48 defines an axis 49 along which the threaded portion 16 is received. The axis also preferably extends through the center of mass of the abrasive article 10.

Most grinding tools, such as the tool 12 illustrated in FIG. 1, include a backing plate that supports various types of the abrasive articles. In the embodiment of FIG. 2, the spindle includes a collar 50 adapted to receive backing plate 52. In an alternate embodiment, the backing plate 52 is threaded onto threaded portion 16. The backing plate 52 is not attached to the abrasive article 10. In the illustrated embodiment, the backing plate 52 does not extend to the edges of the molded abrasive disk 18. The packing plate 52 is preferably removable when the abrasive article 10 is removed from the spindle 14. When the abrasive article 10 is discarded, the backing plate 52 is typically reused.

The backing plate 52 includes distal portions 54 that engage with second major surface 26 of the abrasive article 10. When the abrasive article 10 is attached to the spindle 14, the abrasive material is compressed between the distal portions 54 of the backing plate 52 and rear surface 56 of the outwardly extending flange 30 on the fastener 22. This compressive relationship serves to further secure the fastener 22 to the molded abrasive disk 18.

Figure 4:
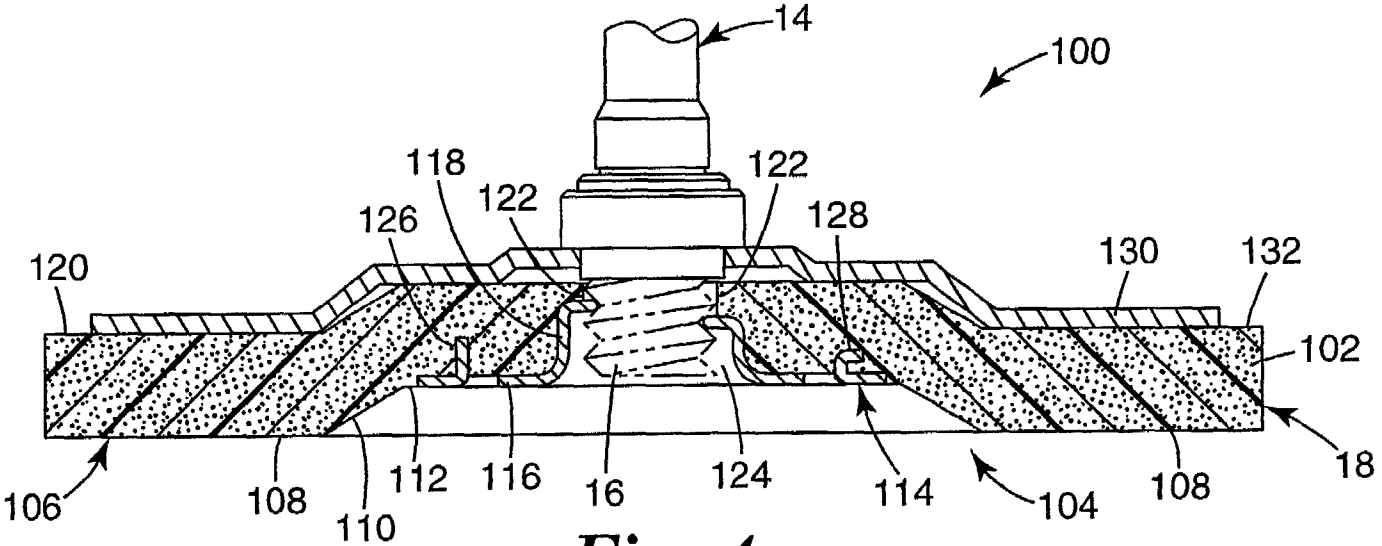
FIG. 4 is a cross-sectional view of an alternate abrasive article in accordance with the present invention.

FIG. 4 illustrates an alternate abrasive article 100 in which the abrasive material 102 is formed with a depressed center section 104. Consequently, the first major surface 106 includes a working surface 108, a tapered surface 110 and a depressed center surface 112. Fastener 114 is integrally molded in the abrasive material 102 so that flange 116 is generally co-planar with the depressed center surface 112.

In the embodiment of FIG. 4, fastener body portion 118 does not extend above second major surface 120. Rather, the fastener 114 is fully embedded in the abrasive material 102. A portion of the abrasive material 102 forms a sidewall 122 defining a portion of aperture 124 that receives threaded portion 16 of the spindle 14. Tine 126 extends generally perpendicular to the flange 116 while tine 128 is bent relative to the flange 116. In the embodiment of FIG. 4, backing plate 130 extends along the second major surface 120 substantially to the edge 132 of the abrasive material 102.

The method of the present invention includes the steps of preparing a mixture of abrasive particles dispersed in a polymeric binder. The polymeric binder is typically thermoset, but can be thermoplastic. The mixture is poured into a form. A fastener with a single internal thread is positioned in the mixture so that a front surface of the fastener does not extend above a first major surface of the mixture. The polymeric binder is cured. The abrasive article is removed from the form. The fastener molded into the abrasive article can be threaded onto a spindle of a tool. In an alternate embodiment, the fastener is located with its front surface resting on a bottom surface of the form. The mixture is poured into the form around the fastener and cured. In some embodiment, the second end of the fastener extends above the mixture in the form. The mixture preferably does not migrate or flow into the center aperture of the fastener.

Figure 5:
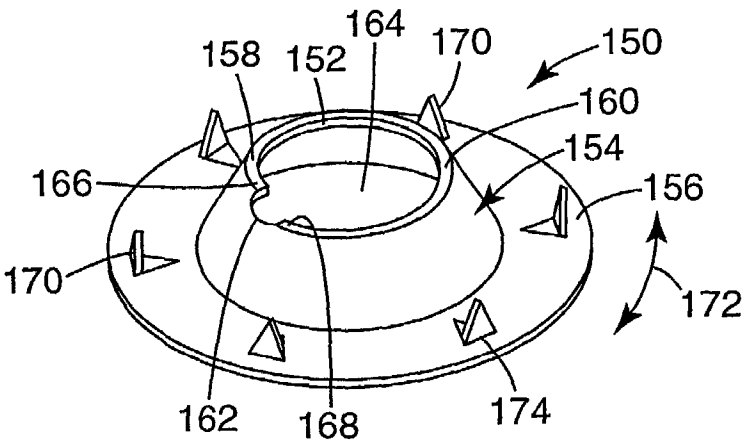
FIG. 5 is a perspective view of a fastener for use in an abrasive article of the present invention.

FIG. 5 is a perspective view of a fastener 150 having a single internal thread 152 in accordance with the present invention. Fastener body portion 154 includes an outwardly extending flange 156 that is positioned near the first major surface of the abrasive material and an inwardly extending flange 158 that is positioned near the second major surface (see FIG. 2). The inwardly extending flange 158 includes a notch 162, typically extending radially from aperture 164, that provides edge portions 166, 168 that are at different elevations with respect to the outwardly extending flange 156. The inwardly extending flange 158 forms a single internal thread 160. The difference in elevations corresponds to the pitch of the threads 16 on the spindle 14. As used herein, "single internal thread" refers to a thread that extends less than 360° around the inside perimeter of an aperture. The fastener 150 of FIG. 5 can preferably be formed at extremely low cost using a stamping process.

Tines 170 are formed in the outwardly extending flange 156. The tines 170 extend from the outwardly extending flange 156 toward the inwardly extending flange 158. Since the tines 170 are intended to resist rotation of the fastener 150 relative to the abrasive material, they are preferably shaped to resist torque 172. In the illustrated embodiment, the tines 170 are stamped from the outwardly extending flange 156 so that bend lines 174 for the tines 170 are generally in the direction of the torque 172. Consequently, the torque 172 acts on the tines 170 perpendicular to the bend lines 174.

Fasteners suitable for use in the present invention include a sheet metal nut or the "Tinnerman" nut fastening device (also referred to as a "treadless fastener") described in U.S. Pat. No. 2,156,002 (Tinnerman). While the Tinnerman nut is the preferred fastening device, other types of fasteners may be used without departing from the spirit and scope of the invention. A commercially available fastener suitable for the present invention is a 1.5 inch (38.1 mm) quick-change button for mating with a ⅝ inch diameter by 11 thread per inch shaft (15.875 mm diameter by 0.43 threads per mm), manufactured by Metal Products Engineering, Los Angeles, Calif. Such fasteners can be formed for example from 28 gauge steel, although other materials (e.g., brass or aluminum) may be used without departing from the spirit and scope of the invention.

Abrasive material used in abrasive articles according to the present invention is abrasive grains or particles disbursed in an organic binder. A reinforcing fibers or a reinforcing mesh or scrim may optionally be molded into or onto a surface of the abrasive article. Examples of filaments include polyester fibers, polyamide fibers, fiber glass, and polyaramid fibers.

Suitable organic binders for making the abrasive material include thermosetting organic binder materials. Examples of suitable thermosetting organic polymers include phenolic resins, urea-formaldehyde resins, melamine-formaldehyde resins, urethane resins, acrylate resins, polyester resins, aminoplast resins having pendant $\alpha,\beta$-unsaturated carbonyl groups, epoxy resins, acrylated urethane, acrylated epoxies, and combinations thereof. The binder and/or abrasive product may also include additives such as fibers, lubricants, wetting agents, thixotropic materials, surfacants, pigments, dyes, antistatic agents (e.g., carbon black, vanadium oxide, graphite, etc.), coupling agents (e.g., silanes, titantates, zircoaluminates, etc.), plasticizers, suspending agents, and the like. The amounts of these optional additives are selected to provide the desired properties. The coupling agents can improve adhesion to the abrasive particles and/or filler. The binder chemistry may be thermally cured, radiation cured or combinations thereof. Additional details on binder chemistry may be found, for example, in U.S. Pat. No. 4,588,419 (Caul et al.), U.S. Pat. No. 4,751,137 (Tumey et al.), U.S. Pat. No. 4,933,373 (Moren), and U.S. Pat. No. 5,436,063 (Follett et al.).

Typically, the abrasive particles have a moh's hardness of at least 5, 6, 7, 8, 9, or even 10. Suitable abrasive grains include fused aluminum oxide (including white fused alumina, heat-treated aluminum oxide and brown aluminum oxide), silicon carbide, boron carbide, titanium carbide, diamond, cubic boron nitride, garnet, fused alumina-zirconia, and sol-gel-derived abrasive particles, and the like. The sol-gel-derived abrasive particles may be seeded or non-seeded. Likewise, the sol-gel-derived abrasive particles may be randomly shaped or have a shape associated with them, such as a rod or a triangle. Examples of sol gel abrasive particles include those described U.S. Pat. No. 4,314,827 (Leitheiser et al.), U.S. Pat. No. 4,518,397 (Leitheiser et al.), U.S. Pat. No. 4,623,364 (Cottringer et al.), U.S. Pat. No. 4,744,802 (Schwabel), U.S. Pat. No. 4,770,671 (Monroe et al.), U.S. Pat. No. 4,881,951 (Wood et al.), U.S. Pat. No. 5,011,508 (Wald et al.), U.S. Pat. No. 5,090,968 (Pellow), U.S. Pat. No. 5,139,978 (Wood), U.S. Pat. No. 5,201,916 (Berg et al.), U.S. Pat. No. 5,227,104 (Bauer), U.S. Pat. No. 5,366,523 (Rowenhorst et al.), U.S. Pat. No. 5,429,647 (Larmie), U.S. Pat. No. 5,498,269 (Larmie), and U.S. Pat. No. 5,551,963 (Larmie), the disclosures of which are incorporated herein by reference. The abrasive grains may also be present in the form abrasive agglomerates.

Abrading with abrasive articles according to the present invention may be done dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like. Abrasive articles according to the present invention may be used with externally-applied abrasive compounds, such as those known as polishing or buffing compounds.

Abrasive articles according to the present invention may be used to abrade workpieces such as aluminum and aluminum alloys, carbon steels, mild steels, tool steels, stainless steel, hardened steel, brass, titanium, glass, ceramics, wood, wood-like materials, plastics, paint, painted surfaces, organic coated surfaces and the like.

A wide variety of backing plate shapes can be used depending upon the end uses of the abrasive article. For example, the backing plate can be tapered so that the center portion of backing plate is thicker than the outer portions. The backing plate can have a uniform or non-uniform thickness. The backing plate can be embossed. The center of the backing plate can be depressed, or lower, than the outer portions. The edges of backing plate can be purposely bent to make a "cupped" disk if so desired. The edges of backing plate can also be smooth or scalloped.

The backing plate is sufficiently tough and heat resistant under severe grinding conditions such that it does not significantly disintegrate or deform from the heat generated during use (e.g., during a grinding, sanding, or polishing operation) and will not significantly crack or shatter from the forces encountered during manufacturing of the abrasive article as well as during use. The backing plate preferably exhibits sufficient flexibility to withstand typical grinding conditions, and preferably severe grinding conditions. Embodiments of the present invention utilize a backing plate that exhibits appropriate shape control and are sufficiently insensitive to environmental conditions, such as humidity and temperature.

The backing plates can be made from various metals, such as steel, aluminum, brass, etc or from a polymeric material. Polymeric backing plates optionally contains at least one of a thermoplastic binder material or a thermoset binder material and an effective amount of a filler and/or fibrous reinforcing material. By an "effective amount" of a reinforcing material, it is meant that the backing plate contains a sufficient amount of the reinforcing material to impart at least improvement in heat resistance, toughness, flexibility, stiffness, shape control, etc., discussed above.

A thermoplastic binder material is a polymeric material (e.g., an organic polymeric material) that softens and melts when exposed to elevated temperatures and generally returns to its original condition (i.e., its original physical state) when cooled to ambient temperatures. During the manufacturing process, the thermoplastic binder material is heated above its softening temperature, or in some instances above its melting temperature, to cause it to flow and form the desired shape of the abrasive article. After the backing plate is formed, the thermoplastic binder is cooled and solidified. In this way the thermoplastic binder material can be molded into various shapes and sizes.

The backing plate can be formed, for example, by shaping or molding the thermoplastic material and/or thermoset binder material using conventional molding techniques such as injection molding. Use of such molding techniques can reduce the amount of materials wasted in construction, relative to conventional "web" processes. Injection molding can also allow for the backing plate to be more concentric than what was previously available. Making the backing plate concentric aids in minimizing or eliminating wobbling during use of the abrasive disk. Additionally, for example, a concentric backing plate may allow tighter manufacturing tolerances to be kept (i.e., when mounting the abrasive material and the fastener). Additionally, for example, higher concentricity of the abrasive disk can minimize curling of the edges of the backing plate. Molding technologies can also allow for controlling shrinkage of the backing plate during manufacturing, and allow for molding structural members (e.g., ridges) into the backing plate, (as is known in the art), to help minimize or prevent warpage.

Web manufacturing processes can also be used to form the backing plate. In a typical web manufacturing process, the backing plate for the abrasive disk is made in a continuous web form and then cut into the desired disk shape. Although injection molding techniques can be used to produce backing plates for the backing plates utilized in the present invention (to provide tighter manufacturing tolerances as well as avoid waste) this is not intended to mean that conventional "web" processes cannot be used. On the contrary, using conventional web processes to form the backing plate may be necessary when using certain embodiments of the backing plate (e.g., thermoplastic and/or thermoset impregnated cloths).

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. An abrasive article for a grinder having a motor-driven, externally-threaded spindle, comprising:

a molded abrasive disk comprising abrasive particles distributed in a binder, the abrasive disk comprising a working surface, a depressed center surface depressed from the working surface, and a second major surface opposite the working surface; and a fastener comprising a body portion wit an aperture and first and second ends, an outwardly extending flange with a front surface at the first end, tines having a portion projecting perpendicular to the outwardly extending flange, and mounting apertures adjacent the tines that connect the molded abrasive disk and the front surface, and an inwardly extending flange comprising a single internal thread at the second end, the fastener being molded into the abrasive disk so that the tines are embedded in the abrasive disk, the front surface of the outwardly extending flange is coplanar with the depressed center surface of the abrasive disk and the inwardly extending flange is embedded between the depressed center surface and second major surface of the abrasive disk.

2. The abrasive article of claim 1 wherein the tines embedded in the abrasive disk comprise a second distal portion at an angle less then ninety degrees with respect to the front surface.

3. The abrasive article of claim 1 wherein the body portion comprises a generally cylindrical shape.

4. The abrasive article of claim 1 wherein the fastener comprises a stamped member.

5. The abrasive article of claim 1 comprising a backing plate adapted to engage with the spindle and the second major surface of the abrasive disk.

6. The abrasive article of claim 5 wherein the abrasive disk is compressed between the backing plate and the outwardly extending flange when the abrasive article is engaged with the treaded spindle.

7. The abrasive article of claim 1 wherein the abrasive disk comprises an integrally molded reinforcing member.

8. The abrasive article of claim 7 wherein the reinforcing member comprises a scrim.

* * * * *

UNITED STATES PATENT AND TRADEMARK OFFICE

CERTIFICATE OF CORRECTION

PATENT NO. : 7,056,200 B2
APPLICATION NO. : 09/945923
DATED : June 6, 2006
INVENTOR(S) : Nelson, Eric W.

It is certified that error appears in the above-identified patent and that said Letters Patent is hereby corrected as shown below:

Column 8 – Line 63 - In Claim 1, delete “wit” and insert - - with - -, therefor.

Signed and Sealed this

Twenty-second Day of August, 2006

JON W. DUDAS
*Director of the United States Patent and Trademark Office*